US005292023A

United States Patent [19]

Yen

[11] Patent Number: 5,292,023

[45] Date of Patent: Mar. 8, 1994

[54] PORTABLE GARBAGE CAN

[76] Inventor: Fong-Chen Yen, No. 22, Jong-Juang Tzyy, Jea-Jong Tsuen, Shiah-Yng Shiang, Tainan Shien, Taiwan

[21] Appl. No.: 111,421

[22] Filed: Aug. 25, 1993

[51] Int. Cl.[5] ..... B65D 43/26

[52] U.S. Cl. ..... 220/264; 220/908

[58] Field of Search ..... 220/262, 263, 264, 324, 220/908

[56] References Cited

U.S. PATENT DOCUMENTS

| | | | |
|---|---|---|---|
| 242,254 | 5/1881 | Bird | 220/264 X |
| 2,072,706 | 3/1937 | Bower | 220/264 |
| 5,170,904 | 12/1992 | Neuhaus | 220/262 |

*Primary Examiner*—Allan N. Shoap
*Assistant Examiner*—Nova Stucker

[57] ABSTRACT

A portable garbage can comprising a cylindrical can body, an annular cap receiver combined with the can body, two half caps swingably combined with the cap receiver, and an inverted L-shaped handle combined with the cap receiver and having a bottom square engage portion to insert in an inner recess of a square plate fixed on one side of the cap receiver, two opposite saw teeth provided in the inner opening of the square engage portion to engage and rotate a stationary tooth respectively fixed on one side of the two half caps to swing open or close an upper opening of the cap receiver combined with the can body for throwing garbage therein.

1 Claim, 5 Drawing Sheets

PORTABLE GARBAGE CAN

BACKGROUND OF THE INVENTION

A known garbage can shown in FIG. 1 comprises a can body 10, a stationary half cap 11 formed on the can body and a movable half cap 12 to close a half opening. When garbage is to be thrown in the can, the half cap is to be moved open with hand. Then the half cap is pulled to close up the opening with hand. But the opening is not so large enough to let garbage thrown, so garbage may often touch or bump against the half cap 11 or the upper curved edge of the can body 10. In addition, the half cap 12 may easily become smeared by hand for opening it, and the can has no means for carrying or lifting up, not convenient for moving it, and if worse, the can body may be fallen down to the ground by accident, with the garbage accumulated therein scattering around.

SUMMARY OF THE INVENTION

This invention has been devised to offer a portable garbage can having the following advantages.

1. It has two half caps to open or close up an upper wide open side of a cap receiver provided on a cylindrical can body so that garbage can be easily thrown in the can body.
2. It has a handle for pulled up to open the two half caps without using hand to directly catch the caps, so user's hands can not be smeared, or the caps are not to be smeared with garbage.
3. It has a handle for carrying this can.
4. It has a cap receiver and a cylindrical can body combined together with stability so that it cannot easily decline to fall down, with the garbage therein being scattered around.
5. The can body and the cap receiver are easily assembled together or taken apart, facilitating it to be washed.

DETAILED DESCRIPTION OF THE INVENTION

Figure 1:
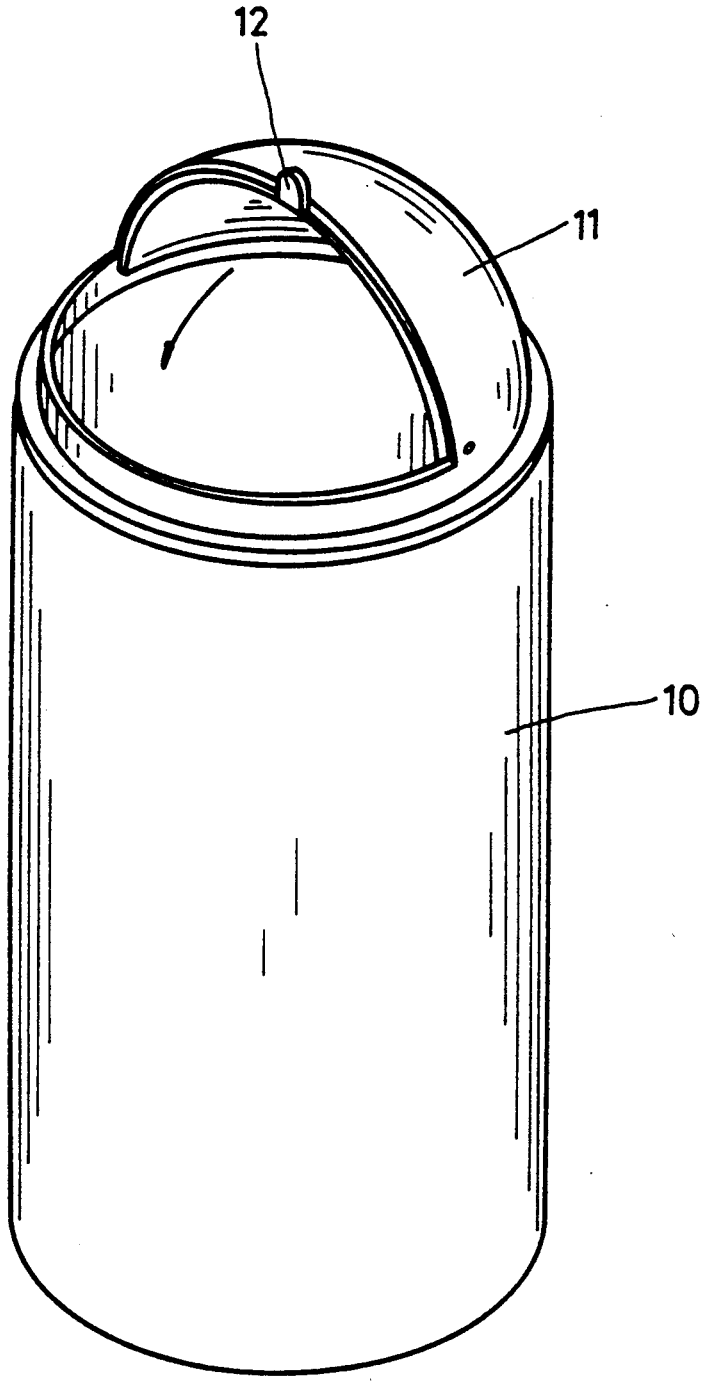
FIG. 1 (PRIOR ART)
FIG. 1 is a perspective view of a conventional garbage can.
Figure 2:
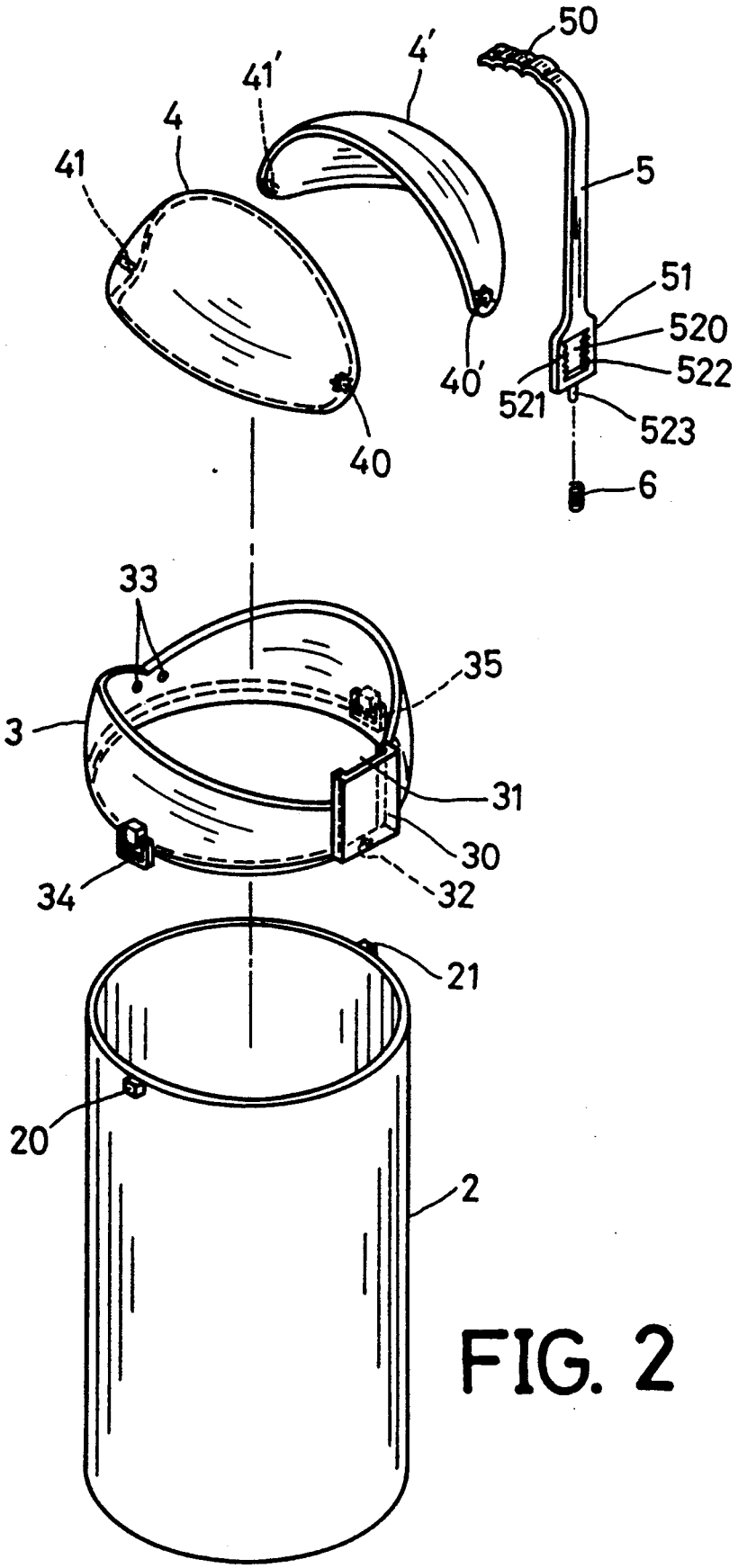
FIG. 2 is an exploded perspective view of a portable garbage can in the present invention.

A portable garbage can in the present invention, as shown in FIG. 2, comprises a cylindrical can body 2, an annular cap receiver 3, two swingable half caps 4, 4' and a handle 5 as main components.

The cylindrical can body 2 has a closed bottom and an open top, and two opposite stop projections 20, 21 on two upper outer opposite edges.

The annular cap receiver 3 fits on the upper circumferential edge of the cylindrical can body 2, two opposite swelled-to-the-middle upper edges, a square plate 30 vertically provided at a meeting point of the two swelled upper edges, an inner recess 31 in the square plate 30, a through hole in an inner lower end of the square plate 30, two fitting holes 33, 33 in the opposite side of the square plate 30, and two opposite hooks 34, 35 to engage the two stop projections 20, 21.

The two swingable half caps 4, 4' are curved and have the same shape and size, combined with the cap receiver 3 by means of two locking teeth 40, 40' and two round projections 41, 41' on two opposite sides of the half caps 4, 4' to engage two saw teeth 521, 522 and the two fitting holes 33, 33 of the cap receiver 3.

The handle 5 is shaped as inverted L, having a bent grip 50 formed in the top end and a square engage portion 51 at the bottom, which has an central aperture 520, two straight vertical saw teeth 521, 522 provided opposite in the aperture 520, a round projection 523 extending down from the bottom of the square engage portion 51 for a spring 6 to fit around.

A coil spring 6 is provided to fit around the round projection 523 of the handle 5, supporting the square engage portion 51 in the inner recess 31 of the square plate 30 of the cap receiver 3, and resting on an inner bottom end of the inner recess 31.

Figure 3:
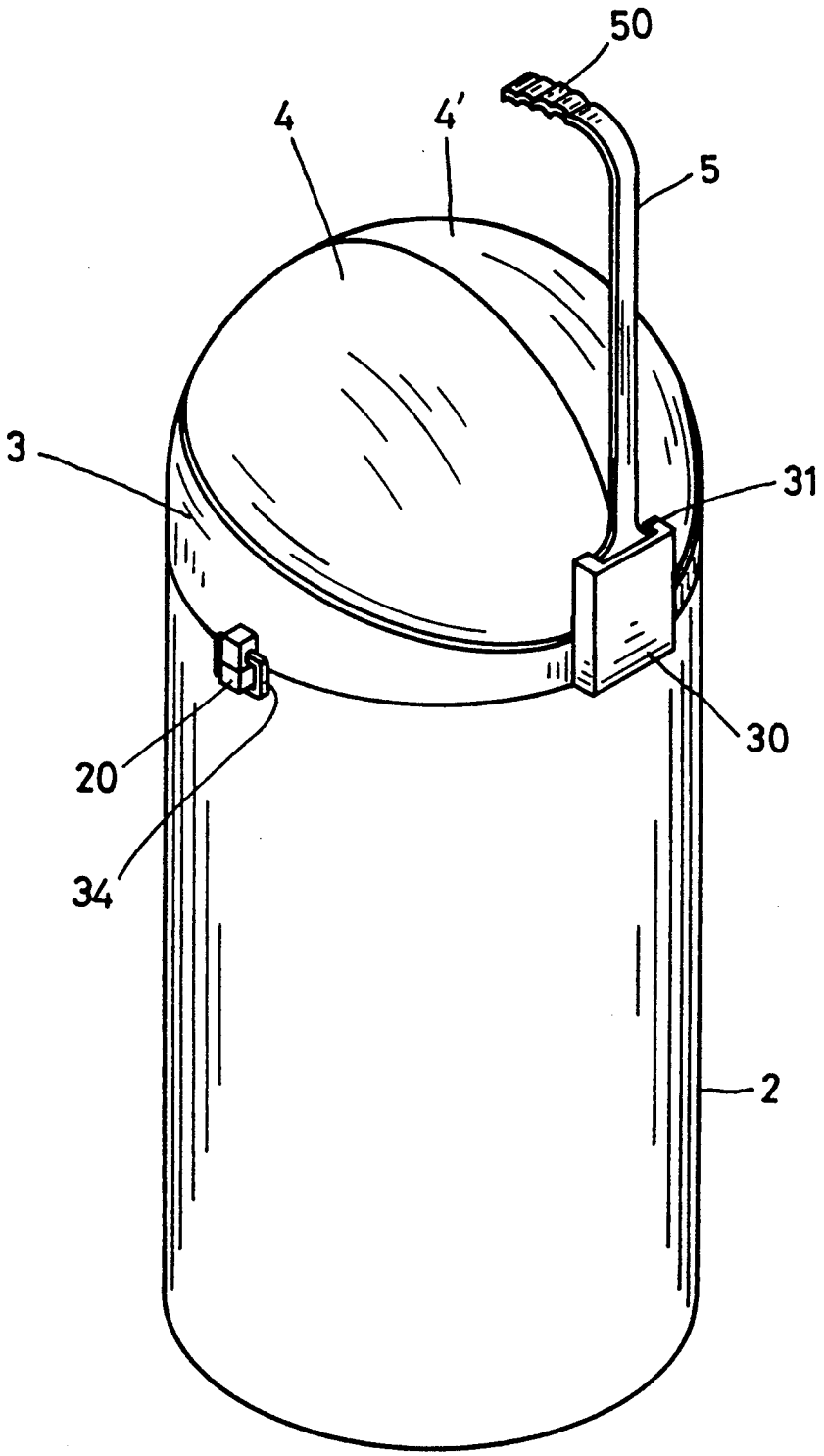
FIG. 3 is a perspective view of the portable garbage can assembled in the present invention.

In assembling, first, the coil spring 6 is fitted around the round projection 523 of the handle 5, and then the square engage portion 51 of the handle 5 is inserted the inner recess 31 of the square plate 30 of the cap receiver 3. Next, the two half caps 4, 4' are combined with the cap receiver 3, by engaging the stationary teeth 40, 40' of the half caps 4, 4' with the two saw teeth 521, 522 of the square engage portions 51 and engaging the round projections 41, 41' with the engage holes 33, 33 of the cap receiver 3. Then the cap receiver 3 is combined with the cylindrical can body 2, by hooking the two hooks 34, 35 with the two stop projections 20, 21 from below, finishing assemblage of this can, as shown in FIG. 3.

Figure 4:
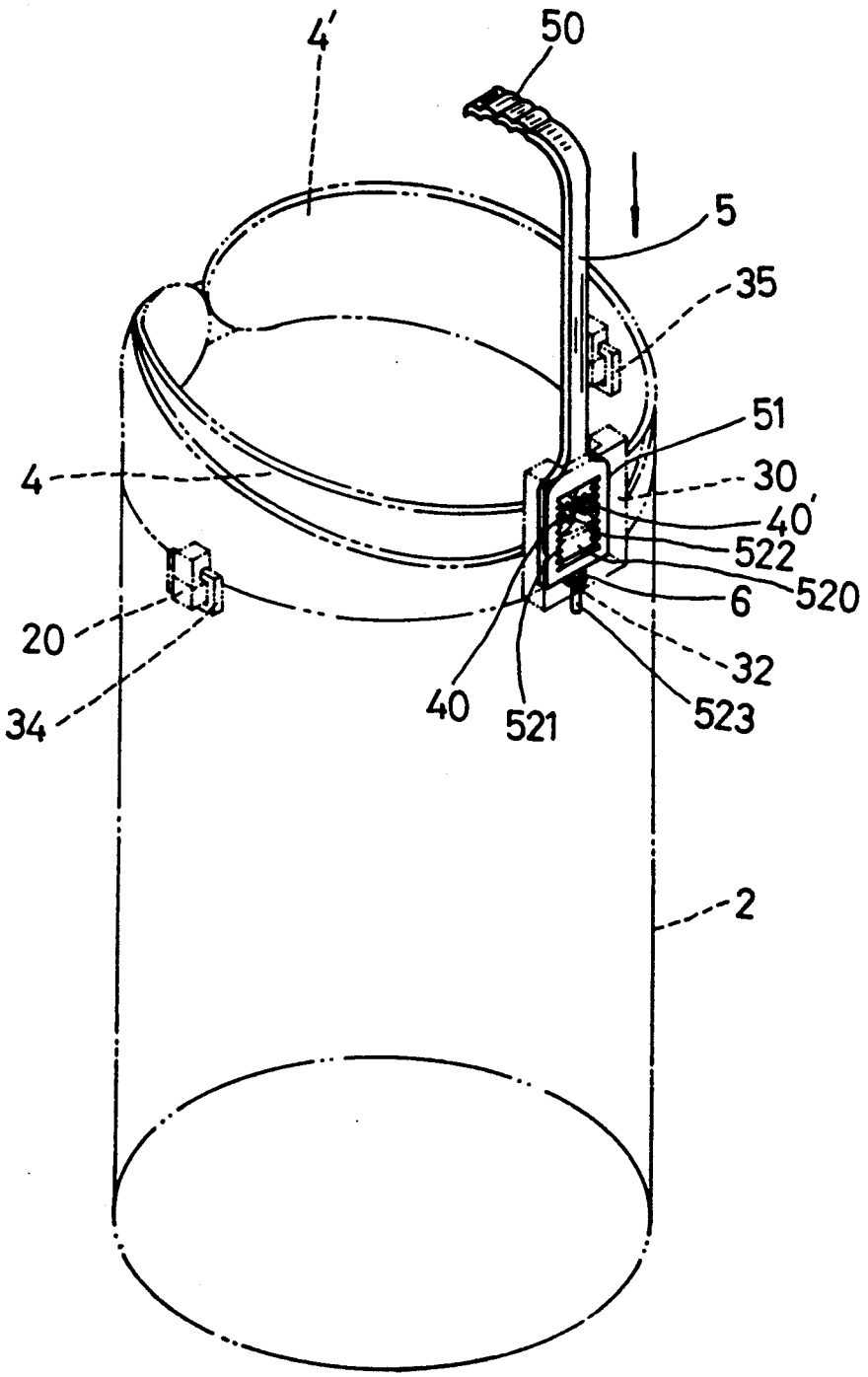
FIG. 4 is a perspective view of the portable garbage can with two half caps opened in the present invention.
Figure 5:
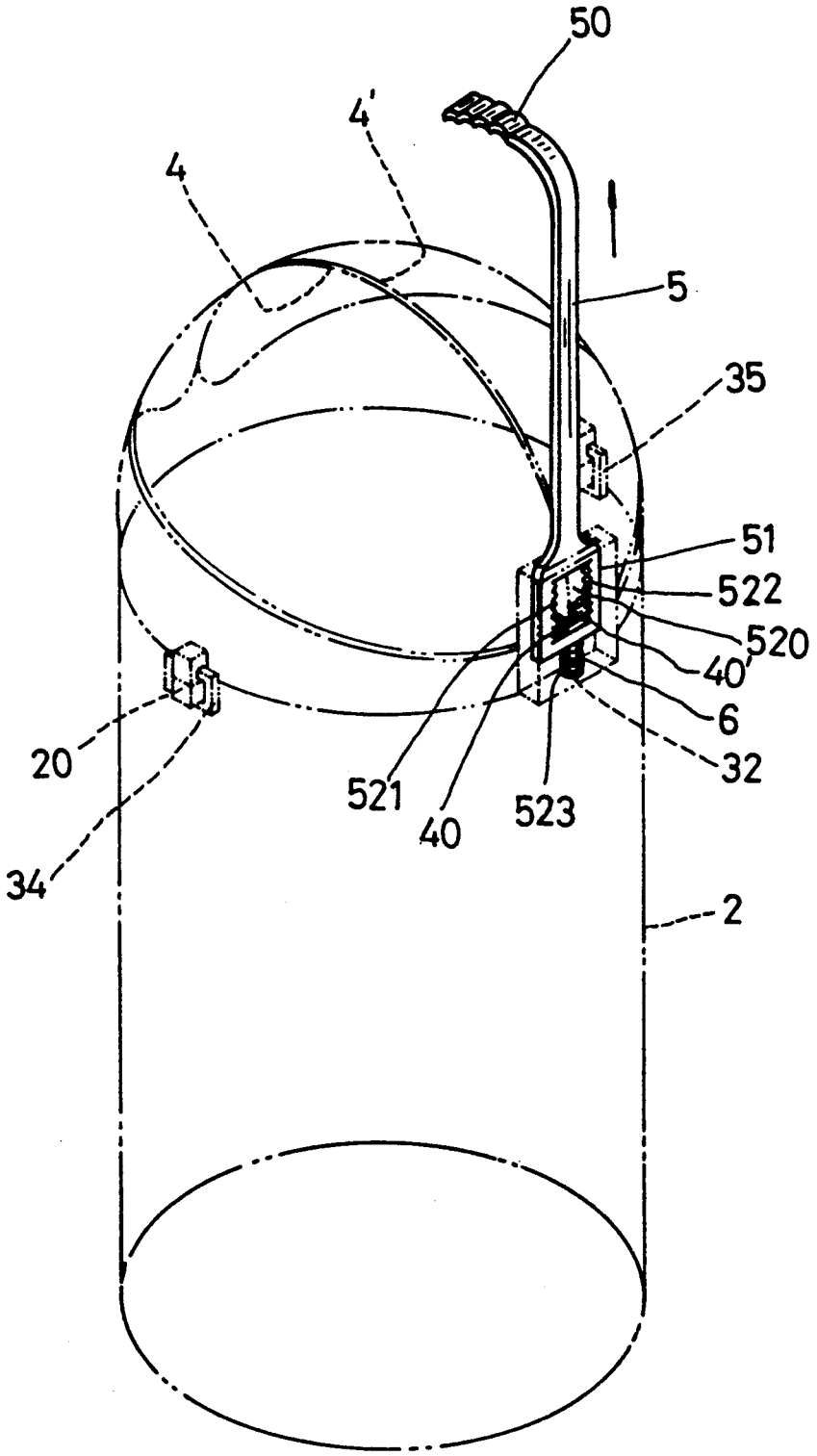
FIG. 5 is a perspective view of the portable garbage can with two half caps closed in the present invention.

In using, as shown in FIG. 4, the handle 5 is pressed down, forcing the saws 521, 522 of the square engage portion 51 move the two teeth 40, 40' of the two half caps 4, 4', and then the two half caps 4, 4' being moved to the two sides of the cap receiver 3 respectively to open the upper open side of the cap receiver 3 for throwing garbage into the can body 2. At this time, the coil spring 6 is compressed, and the round projection 523 is passing through the hole 32. After the garbage is thrown therein, the hand is released from the grip 50 of the handle 5. Then the two half caps 4, 4' are swung to close up the upper open side of the cap receiver 3, with the teeth 40, 40' pushed by the saw teeth 521, 522 in the square engage portion 51 pushed up by the coil spring 6 so far compressed by hand. Meanwhile, the handle 5 will also automatically be raised up to the original position by the coil spring 6.

What is claimed is:

1. A portable garbage can comprising:

a cylindrical can body having a bottom closed, an open top, and two opposite stop projections on the top end;

an annular cap receiver hooked on the open top of said cylindrical can body, having an open top, two opposite swelled-to-the-middle upper edges, a square plate at one side, said square plate having an inside recess for receiving a square engage portion of a handle therein and a vertical hole in an inside bottom end, two engage holes in the other side of said square plate, two opposite hooks on a bottom edge for hooking said stop projections of said cylindrical body can to combine the cap receiver with said can body;

two half caps pivotally combined with said cap receiver, respectively having a curved shape of the same size, a stationary tooth on one side and a round projection on the opposite side;

a handle of an inverted L shape, having an upper horizontal portion being corrugated for gripping, a square engage portion formed at a bottom end and inserting in said inside recess of said square plate of said cap receiver, said square engage portion having two vertical opposite saw teeth on two opposite inner vertical sides to engage said two stationary teeth of said two half caps, and a round projection extending down from the bottom of said square engage portion;

a coil spring provided to fit around said round projection of said handle and resting on a bottom inner edge of said square plate; and said two half caps being in a closed position (the original position) when said handle is not pressed down and pushed up by said coil spring, with the upper portions of said two saw teeth engaging said stationary teeth of said half caps, said half caps being in an open position for garbage to be thrown in said can body through said cap receiver when said handle is pressed down with hand to compress said coil spring, with said square engage portion moving up to rotate said two stationary teeth of said half caps, forcing said half caps swing outward, said two half caps being automatically moved to the original position, i.e. the closed position, in case the handle is released to be moved up by elasticity of said coil spring, said handle possible to be caught with hand to move this whole can by hooking the cap receiver with the can body without the garbage therein falling out to scatter around.

* * * * *